United States Patent [19]

Battle

[11] Patent Number: 4,651,359

[45] Date of Patent: Mar. 24, 1987

[54] DUAL MODE FLUSH VALVE ASSEMBLY

[76] Inventor: John R. Battle, 1109 Pine Ridge Circle W. Apt. 103-R2, Tarpon Springs, Fla. 33589

[21] Appl. No.: 853,998

[22] Filed: Apr. 21, 1986

[51] Int. Cl.[4] ..... E03D 1/14; E03D 3/12

[52] U.S. Cl. ..... 4/324; 4/325; 4/345; 4/381; 4/415

[58] Field of Search ..... 4/325, 324, 384–385, 4/378, 380, 381, 391, 395, 396, 405, 415, 249

[56] References Cited

U.S. PATENT DOCUMENTS

| | | | |
|---|---|---|---|
| 2,532,977 | 12/1950 | White | 4/325 |
| 2,922,168 | 1/1960 | Crandall | 4/384 |
| 3,026,536 | 3/1962 | Wood | 4/324 |
| 3,156,930 | 11/1964 | Moulton et al. | 4/325 |
| 3,538,519 | 11/1970 | Weisz | 4/325 |
| 3,839,746 | 10/1974 | Kowalski | 4/325 |
| 4,032,997 | 7/1977 | Phripp et al. | 4/324 |
| 4,216,555 | 8/1980 | Detjen | 4/325 |
| 4,391,003 | 7/1983 | Talerico et al. | 4/325 |

*Primary Examiner*—Henry K. Artis

*Attorney, Agent, or Firm*—Arthur W. Fisher, III

[57] ABSTRACT

A dual mode flush valve assembly selectively operable in a full or partial flush mode for use with a toilet flush tank assembly including a flush actuator movable between a first and second position interconnected to a buoyant flush valve movable between an open and closed position, the dual mode flush valve assembly comprising a flush valve actuator assembly movable between an upper buoyant position, an intermediate full flush position and a lower partial flush position in combination with a flush valve control assembly movable between a first and second position disposed to selectively engage the flush valve actuator assembly when in the first position such that when the flush actuator is in the first position the flush valve actuator assembly is in the upper buoyant position and the buoyant flush valve is in the closed position, when the flush actuator is moved from the first to second position for less than a predetermined period of time moving the buoyant flush valve to the open position, the flush valve actuator assembly moves downward to the intermediate full flush position to engage the flush valve control assembly in the first position whereby the flush valve actuator assembly is held in spaced relation relative to the buoyant flush valve to provide the full flush mode and when the flush actuator is moved from the first to second position for more than the predetermined period of time moving the buoyant flush valve to the open position and the flush valve actuator assembly to the second position the flush valve actuator assembly moves downward to the lower partial flush position to engage the flush valve moving the buoyant flush valve to the closed position to provide the partial flush mode.

16 Claims, 6 Drawing Figures

FIG. 1
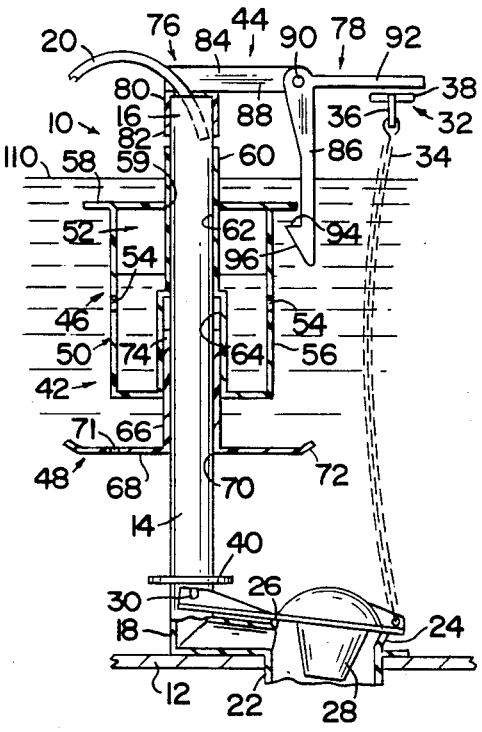
FIG. 2
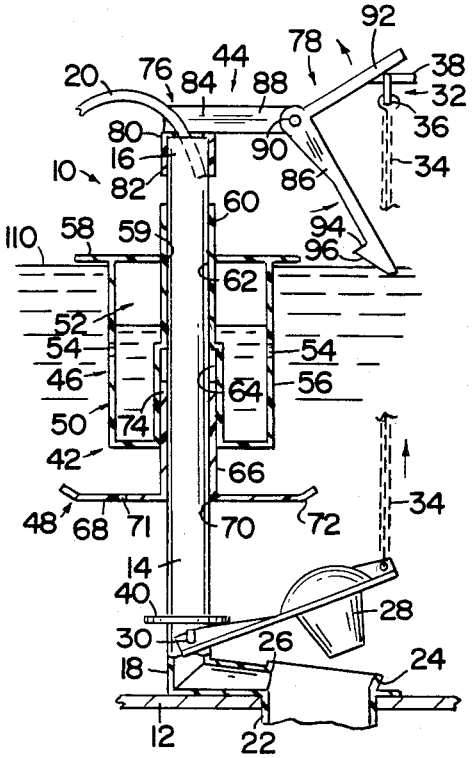
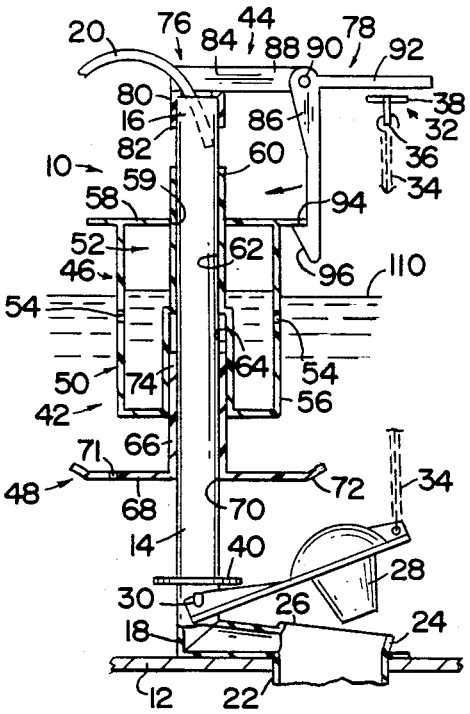
FIG. 3
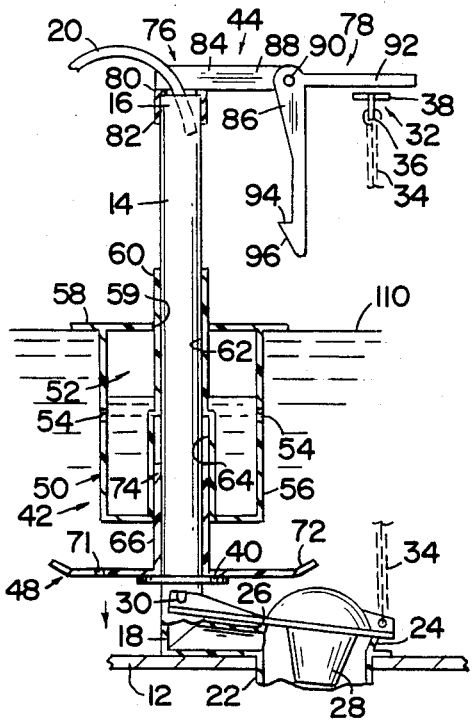
FIG. 4

DUAL MODE FLUSH VALVE ASSEMBLY

BACKGROUND OF THE INVENTION

1. Field of the Invention

The present invention relates to dual mode flush valve assembly selectively operable in a full or partial flush mode for use with a toilet flush tank assembly.

2. Description of the Prior Art

Normally the flush cycle of most toilets is initiated by moving a lever to unseat a plug or seal from the bottom of a storage tank to release the stored water into the toilet bowl. A siphonic action siphons the water out of the bowl and into a drain pipe which carries the flushed contents to the sewer system. The normal capacity of storage tanks used for this purpose is sufficient to initiate the siphonic action and to refill the trap in the bowl once the flush cycle has begun. As the remaining water drains from the tank into the trap, the plug or seal reseal the tank and fresh water fills the tank for the succeeding flush cycle.

Most conventional toilets use approximately five gallons of water per flush. Many efforts have been developed to reduce this water consumption. These include such simple measures as placing a brick or a weighted plastic bottle in the tank to displace a volume of water; bending the float rod downward to reduce the amount of water required to fill the tank to the operating level; or placing a baffle in the tank against a side wall or around the drain hole to keep some of the water in the tank. More complex measures include using specially designed shallow trap model toilets, or models which use air pressure or mineral oil as a flushing agent. These alternative methods and devices are generally either prohibitively expensive or save water at the expense of flushing performance, disadvantages which are normally unacceptable.

Detjen, U.S. Pat. No. 4,216,555, shows a dual flush system tank operable in either a full flush or a partial flush. A control handle is actuated normally to produce a full flush. If a partial flush is desired, the control handle is held in a depressed condition for two or three seconds before release to produce a partial flush. A partial flush is produced by a buoyant reseating weight which will float down with the falling level of liquid in the tank to depress the flush ball and prematurely reseat the flush ball with only part of the liquid discharged from the tank. For a full flush, the control handle is released and immediately re-engaged before the buoyant reseating weight moves downwardly in the tank and latched against premature seating of the flush ball.

Renz, U.S. Pat. No. 4,328,596, discloses a system to drain a toilet tank either partially or completely.

Kloner, U.S. Pat. No. 4,485,501, shows a toilet flush mechanism to conserve water by directional at rotation of the flushing handle to actuate a first lever initiating the discharge of a full tank of water or actuate a second lever initiating the discharge of a predetermined fraction of the water in the full tank.

Phripp, U.S. Pat. No. 4,032,997, discloses a flush regulator for use in a toilet flush tank to regulate the outflow from the flush tank through an outlet pipe.

Meier, U.S. Pat. No. 4,486,906, shows a flush valve assembly for use in a toilet storage tank. A valve cup having a float is rotatably mounted within a housing including an elongated horizontal slot. The valve cup contains water when the storage tank is full, and upon initiation of a flush cycle, the float engages an abutment which is secured to a valve shaft to retard the rate of descent of the valve shaft by floating downwardly in the valve cup as the water drains from the horizontal slot. The valve cup can be rotated to variably restrict the slot to increase or decrease the rate of descent of the valve shaft to seal the tank as soon as the trap has been refilled.

SUMMARY OF THE INVENTION

The present invention relates to dual mode flush valve assembly selectively operable in a full or partial flush mode for use with a toilet flush tank assembly.

The toilet flush tank assembly comprises a toilet tank having a overflow pipe disposed therein in fluid communication with a fluid supply conduit and a toilet tank outlet including a valve seat. The valve seat is selectively sealed by a buoyant flush valve pivotally coupled to the lower portion of the overflow pipe. The buoyant flush valve is operatively coupled to a flush actuator movable between a first and second position to selectively control the position of the dual mode flush valve assembly and buoyant flush valve.

The dual mode flush valve assembly comprises a flush valve actuator assembly and a flush valve control assembly disposed within the toilet tank.

The flush valve actuator assembly comprises an upper float and lower flush valve actuator movably mounted on the overflow pipe movable between an upper buoyant position, an intermediate full flush position and a lower partial flush position. The upper float comprises a hollow member forming a fluid chamber having at least one fluid port formed in the side wall thereof. A retainer element including a centrally disposed aperture extends outwardly from the upper end of the hollow member. The lower flush valve actuator comprises a lower actuator flange including a centrally disposed aperture. The outer periphery or edge of the actuator flange may be curved upwardly or arcuate to selectively engage the buoyant flush valve when the flush valve actuator assembly is in the lower partial flush position.

The flush valve control assembly comprises a stationary attachment member and movable flush valve control member. The stationary attachment member comprises an attachment element coupled to the upper portion of the overflow tube having a stop element formed thereon to engage the flush valve actuator assembly when in the upper buoyant position to limit the upward movement thereof. The stationary attachment frame is configured to allow placement of the fluid supply conduit and to allow water to enter the top of the overflow tube. The movable flush valve control member comprises a normally vertical retainer element pivotally mounted to the stationary attachment member formed on the lower portion of the normally vertical retainer element is a normally horizontal retainer surface and an inclined cam surface. The retainer element is disposed in spaced relation relative to the normally horizontal retainer surface when the flush valve actuator assembly is in the upper buoyant position and the flush valve control assembly is in the first position and to engage the normally horizontal retainer surface when the flush valve actuator assembly is in the intermediate full flush position and the flush valve control assembly is in the first position.

When in the upper buoyant position, the flush valve actuator assembly is submerged when the water level in the toilet tank is at a maximum level. For a normal flush to release the full volume of water in the toilet tank, the flush actuator is depressed and then released normally within a predetermined period of time to open the buoyant flush valve. Since the flush valve actuator assembly is initially submerged, the flush valve actuator assembly does not begin to descend until the water level in the toilet tank has dropped a predetermined amount. The amount of water level drop decrease is such that when the flush actuator is released before the predetermined period of time the movable flush valve control member engages the retainer element to stop the downward travel of the flush valve actuator assembly. The lower flush valve actuator will not contact the buoyant flush valve thus permitting a full flush mode.

To effect a partial discharge of the toilet tank, the flush actuator is depressed or actuated for slightly longer period of time. This allows the flush valve actuator assembly to travel downward past the movable flush valve control member before the movable flush valve control member returns to the first position. The flush valve actuator assembly continues downward in response to the decrease water level within the toilet tank. When the water level reaches a predetermined level, the lower flush valve actuator engages the buoyant flush valve closing the buoyant flush valve stopping the discharge of water from the toilet tank providing the partial flush mode.

After the discharge of water from the toilet tank has ceased, the water level begins to rise with the toilet tank. The flush valve actuator assembly will move upwardly on the overflow pipe. The inclined cam surface will engage the flush valve actuator assembly to rotate the movable flush valve control member and allow the flush valve actuator assembly to continue upward to the upper buoyant position. The movable flush valve control member then rotates to the first or closed position through gravity.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which:

FIG. 1 is a cross-sectional front view of the dual mode flush valve assembly with the flush valve actuator assembly in the upper buoyant position.

FIG. 2 is a cross-sectional front view of the dual mode flush valve assembly with the flush valve actuator assembly in transition between the upper buoyant position and the intermediate full flush position.

FIG. 3 is a cross-sectional front view of the dual mode flush valve assembly with the flush valve actuator assembly in the intermediate full flush position.

FIG. 4 is a cross-sectional front view of the dual mode flush valve assembly with the flush valve actuator assembly in the lower partial flush position.

Similar reference characters refer to similar parts throughout the several views of the drawings.

DETAILED DESCRIPTION OF THE PREFERRED EMBODIMENT

Figure 5:
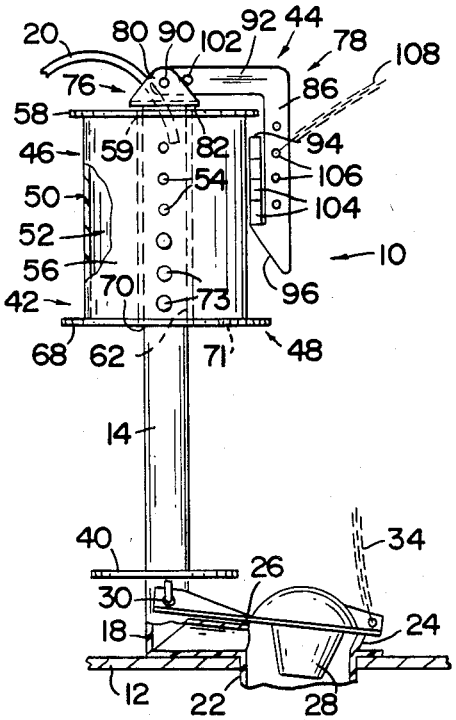
FIG. 5 is a cross-sectional front view of an alternate embodiment of the dual mode flush valve assembly.

As best shown in FIGS. 1 through 4, the present invention relates to dual mode flush valve assembly generally indicated as 10 selectively operable in a full or partial flush mode for use with a toilet flush tank assembly.

As shown in FIGS. 1 through 4, the toilet flush tank assembly comprises a toilet tank partially shown as 12 having a substantially vertical overflow pipe 14 disposed therein. The upper and lower portions 16 and 18 respectively of substantially vertical overflow pipe 14 are in fluid communication with a fluid supply conduit 20 and a toilet tank outlet 22 respectively. The upper portion 24 of the toilet tank outlet 22 includes a valve seat 26. The valve seat 26 is selectively sealed by a buoyant flush valve 28 pivotally coupled to the lower portion 18 of the substantially vertical overflow pipe 14 by a pivot member 30. The buoyant flush valve 28 is operatively coupled to a flush actuator generally indicated as 32 by an interconnecting linkage 34. The flush actuator 32 movable between a first and second position comprises a flush actuator handle 36 disposed on the exterior of the toilet tank 12 and flush valve actuator element 38 disposed to selectively actuate the dual mode flush valve assembly 10 and buoyant flush valve 28. A buoyant flush valve stop 40 is mounted to the lower portion 18 of the substantially vertical overflow pipe 14 to limit the upward rotational movement of the buoyant flush valve 28.

As best shown in FIGS. 1 through 4, the dual mode flush valve assembly 10 comprises a flush valve actuator assembly and a flush valve control assembly generally indicated as 42 and 44 respectively disposed within the toilet tank 12.

As best shown in FIGS. 1 through 4, the flush valve actuator assembly 42 comprises an upper float and lower flush valve actuator generally indicated as 46 and 48 respectively movably mounted on the substantially vertical overflow pipe 14. As shown in FIGS. 2 through 4, the flush valve actuator assembly 42 is movable between an upper buoyant position, an intermediate full flush position and a lower partial flush position as described more fully hereinafter.

The upper float 46 comprises a hollow substantially cylindrical member 50 forming a fluid chamber 52. At least one fluid port 54 is formed in the side wall 56 of the hollow substantially cylindrical member 50. A substantially horizontal circular retainer element 58 having a centrally disposed aperture 59 formed therein and a first hollow substantially vertical cylindrical stop element 60 extend outwardly and upwardly respectively from the upper end of the hollow substantially cylindrical member 50. A centrally disposed channel 62 including a lower offset recess 64 formed in the lower portion thereof extends through the hollow substantially cylindrical member 50 which in combination with the concentrically aligned interior of the first hollow substantially vertical cylindrical stop element 60 permits the upper float 46 to be mounted on the substantially vertical overflow tube 14.

The lower flush valve actuator 48 comprises an upper hollow substantially vertical cylindrical member 66 having a lower substantially horizontal actuator flange 68 including a centrally disposed aperture 70 and fluid port 71 extending outwardly from the lower portion therof. The outer periphery or edge 72 of the actuator flange 68 is curved upwardly or arcuate to engage the buoyant flush valve 28 when the flush valve actuator assembly 42 is in the lower partial flush position. The interior of the upper hollow substantially vertical cylindrical member 66 and the centrally disposed aperture 70 are concentrically aligned to permit the lower flush valve actuator 48 to be mounted on the substantially vertical overflow tube 14. The upper portion 74 of the upper hollow substantially vertical cylindrical member 66 is press fit within the lower offset recess 64 to permit telescoping adjustment of the upper float 46 and lower flush valve actuator 48 relative to each other as flush regulator means to control the amount of water discharged from the toilet tank 12 in the partial flush mode.

As best shown in FIGS. 1 through 4, the flush valve control assembly 44 comprises a stationary attachment member and movable flush valve control member generally indicated as 76 and 78 respectively.

The stationary attachment member 76 comprises an attachment element 80 coupled to the upper portion 16 of the substantially vertical overflow tube 14 having a second stop element 82 formed thereon to engage the first hollow substantially vertical cylindrical stop element 60 when the flush valve actuator assembly 42 is in the upper buoyant position to limit the upward movement thereof and a substantially horizontal attachment element 84. The stationary attachment frame 76 is configured to allow placement of the fluid supply conduit 20 and to allow water to enter the top of the substantially vertical overflow tube 14.

The movable flush valve control member 78 comprises a normally vertical retainer element 86 pivotally mounted to the outer portion 88 of the substantially horizontal attachment element 84 by a pivot member 90 and a normally horizontal flush valve control element 92. Formed on the lower portion of the normally vertical retainer element 86 is a normally horizontal retainer surface 94 the center of which is vertically aligned with the pivot member 90 and an inclined cam surface 96.

The vertical alignment is such that the downward force of the flush valve actuator assembly 42 against the normally horizontal retainer surface 94 will not rotate the flush valve control assembly 44 when the flush valve actuator assembly 42 is in the intermediate full flush position. The substantially horizontal circular retainer element 58 is disposed in spaced relation relative to the normally horizontal retainer surface 94 when the flush valve actuator assembly 42 is in the upper buoyant position and the flush valve control assembly 44 is in the first position and to engage the normally horizontal retainer surface 94 when the flush valve actuator assembly 42 is in the intermediate full flush position and the flush valve control assembly 44 is in the first position. The normally horizontal flush valve control element 92 is disposed to engage the flush valve actuator member 38 when the flush actuator 32 is in the second position to move the flush valve control assembly 44 to the second position such that the flush valve actuator assembly 42 may move to the lower partial flush position after a predetermined period of time.

Figure 6:
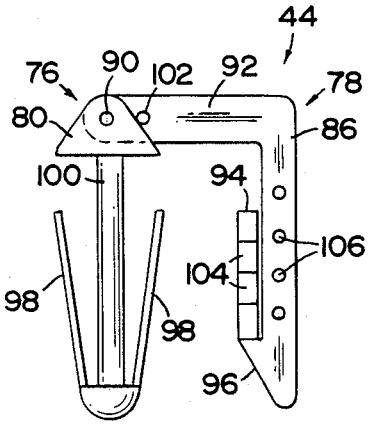
FIG. 6 is an enlarged view of the flush valve control assembly.

FIGS. 5 and 6 show an alternate embodiment of the dual mode flush valve assembly 10 comprising a flush valve actuator assembly and a flush valve control assembly generally indicated as 42 and 44 respectively disposed within the toilet tank 12.

As shown in FIGS. 5 and 6, the flush valve actuator assembly 42 comprises an upper float and lower flush valve actuator generally indicated as 46 and 48 respectively movably mounted on the substantially vertical overflow pipe 14. The flush valve actuator assembly 42 is movable between an upper buoyant position, an intermediate full flush position and a lower partial flush position as described more fully hereinafter The upper float 46 comprises a hollow substantially cylindrical member 50 forming a fluid chamber 52. A plurality of fluid ports 54 are formed in the side wall 56 of the hollow substantially cylindrical member 50. A substantially horizontal circular retainer element 58 having a centrally disposed aperture 59 formed therein extends outwardly from the upper end of the hollow substantially cylindrical member 50. A centrally disposed channel 62 extends through the hollow substantially cylindrical member 50 and centrally disposed aperture 59 permits the flush valve actuator assembly 42 to be mounted on the substantially vertical overflow tube 14.

The lower flush valve actuator 48 comprises a lower substantially horizontal actuator flange 68 including a centrally disposed aperture 70 to engage the buoyant flush valve 28 when the flush valve actuator assembly 42 is in the lower partial flush position. A lower fluid port 71 is formed in the lower substantially horizontal actuator flange 68. The centrally disposed aperture 70 permits the lower flush valve actuator 48 to be mounted on the substantially vertical overflow tube 14.

One or more of the plurality of the fluid ports 54 may be selectively plugged or closed by a corresponding plug each indicated as 73 as a flush regulator means to control the amount of water 110 discharged from the toilet tank 12 in the partial flush mode. Alternately, a detachable membrane or triangular element rotatably mounted on the hollow substantially cylindrical member 50 may be used to selectively close one or more of the fluid ports 54. The amount of water 110 discharged from the toilet tank 12 during the partial flush mode is directly preportional to the amount of air within the hollow substantially cylindrical member 50.

As shown in FIGS. 5 and 6, the flush valve control assembly 44 comprises a stationary attachment member and movable flush valve control member generally indicated as 76 and 78 respectively.

The stationary attachment member 76 comprises an attachment element 80 coupled to the upper portion 16 of the substantially vertical overflow tube 14 having a stop element 82 formed thereon to engage the flush valve actuator assembly 42 when the flush valve actuator assembly 42 is in the upper buoyant position to limit the upward movement thereof. The attachment element 80 is interconnected to at least one resilient retainer element 98 by a substantially vertical interconnecting element 100 to secure the stationary attachment member 76 to the substantially vertical overflow pipe 14. The stationary attachment member 76 is configured to allow placement of the fluid supply conduit 20 and to allow water to enter the top of the substantially vertical overflow tube 14.

The movable flush valve control member 78 comprises a normally vertical retainer element 86 pivotally mounted on the stationary attachment member 76 by a pivot member 90 and a normally horizontal flush valve control element 92. Formed on the lower portion of the normally vertical retainer element 86 is a normally horizontal retainer surface 94 and an inclined cam surface 96. A limit pin 102 is formed on the normally horizontal flush valve control element 92 to selectively engage the attachment element 80 to limit the downward rotational movement of the movable flush valve control member 78. A plurality of detachable tabs each indicated as 104 and a plurality of attachment apertures each indicated as 106 are formed on the movable flush valve control member 78.

The substantially horizontal circular retainer element 58 is disposed in spaced relation relative to the normally horizontal retainer surface 94 when the flush valve actuator assembly 42 is in the upper buoyant position and the flush valve control assembly 44 is in the first position and to engage the normally horizontal retainer surface 94 when the flush valve actuator assembly 42 is in the intermediate full flush position and the flush valve control assembly 44 is in the first position. The normally vertical retainer element 86 is interconnected to the flush valve actuator member 38 by an interconnecting element 108 such that when the flush actuator 32 is in the second position the flush valve control assembly 44 moves to the second position such that the flush valve actuator assembly 42 may move to the lower partial flush position after a predetermined period of time.

The volume of water 110 discharged during the partial flush mode is directly proportional to the amount of water within the upper float 46 which determines the vertical dimension of the flush valve actuator assembly 42 submerged as well as the time lapse before the flush valve actuator assembly 42 begins to descend once the flush actuator 32 is moved from the first to second position. The predetermined period of time is determined by the vertical separation between the substantially horizontal circular retainer element 38 and the normally horizontal retainer surface 94 when the flush valve actuator assembly 42 is in the upper buoyant position. The virtual or effective separation may be selectively varied by removing one or more of the detachable tabs 104.

FIG. 1 shows the flush valve actuator assembly 42 in the upper buoyant position. Upper movement of the flush valve actuator assembly 42 is limited by the stop element 82 such that the flush valve actuator assembly 42 is submerged when the water 110 in the toilet tank 12 is at a maximum.

As shown in FIGS. 2 and 3 for a normal flush to release the full volume of water 110 in the toilet tank 12, the flush actuator 32 is depressed and then released normally within a predetermined period of time to open the buoyant flush valve 28 and move the movable flush valve control member 78 to the second position. Since the flush valve actuator assembly 42 is initially submerged, the flush valve actuator assembly 42 does not begin to descend until the water 110 in the toilet tank 12 has dropped a predetermined amount. The amount of water level 110 decreases such that when the flush actuator 32 is released before the predetermined period of time the movable flush valve control member 78 returns to the first position to stop the downward travel of the flush valve actuator assembly 42. The lower flush valve actuator 48 will not engage the buoyant flush valve 28 to provide a full flush mode.

As shown in FIGS. 2 and 4 to effect a partial discharge of the toilet tank 12, the flush actuator 32 is depressed or actuated for slightly longer period of time. This allows the flush valve actuator assembly 42 to travel downward past the movable flush valve control member 78 before the movable flush valve control member 78 returns to the first position (FIG. 3). The flush valve actuator assembly 42 continues downward in response to the decrease of water 110 within the toilet tank 12. When the water 110 reaches a predetermined level, the lower flush valve actuator 48 will engage the buoyant flush valve 28 to close the buoyant flush valve 28 stopping the discharge of water 110 from the toilet tank 12.

As shown in FIGS. 1 through 4, the upper hollow substantially vertical cylindrical member 66 is press fit into the upper float 46 to adjust the vertical distance between the lower substantially horizontal actuator flange 68 and the substantially horizontal circular retainer element 58 to vary the volume of water 110 discharged during the partial flush mode. Alternately one or more of the plurality apertures 54 may be plugged or closed by plugs 73 as a flush regulator means to control the amount of water 110 discharged from the toilet tank 12 in the partial flush mode.

One or more of the detachable tabs 104 may be removed to incrementally control the predetermined period of time. The greater the vertical distance between the substantially horizontal circular retainer element 58 and upper most normally horizontal retainer surface 94 the greater the predetermined period of time. After discharge of water 110 from the toilet tank 12 has ceased the water level begins to rise. The flush valve actuator assembly 42 will move upwardly on the substantially vertical overflow pipe 14. The inclined cam surface 96 will engage the flush valve actuator assembly to rotate the movable flush valve control member 78 and allow the flush valve actuator assembly 42 to continue upward to the upper buoyant position. The movable flush valve control member 78 then rotates to the first or closed position through gravity.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A dual mode flush valve assembly selectively operable in a full or partial flush mode for use with a toilet flush tank assembly including a flush actuator movable between a first and second position interconnected to a buoyant flush valve movable between an open and closed position, the dual mode flush valve assembly comprising a flush valve actuator assembly movable between an upper buoyant position, an intermediate full flush position and a lower partial flush position in combination with a flush valve control assembly movable between a first and second position disposed to selectively engage said flush valve actuator assembly when in said first position such that when the flush actuator is in the first position and said flush valve actuator assembly is in the upper buoyant position and the buoyant flush valve is in the closed position, when the flush actuator is moved from the first to second position for less than a predetermined period of time moving the buoyant flush valve to the open position said flush valve actuator assembly moves downward to said intermediate full flush position to engage said flush valve control assembly in said first position whereby said flush valve actuator assembly is held in spaced relation relative to the buoyant flush valve to provide said full flush mode and when the flush actuator is moved from the first to second position for more than said predetermined period of time moving the buoyant flush valve to the open position and said flush valve actuator assembly to said second position said flush valve actuator assembly moves downward to said lower partial flush position to engage and move the buoyant flush valve to the closed position to provide said partial flush mode.

2. The dual mode flush valve assembly of claim 1 wherein said flush valve actuator assembly comprising an upper float and lower flush valve actuator.

3. The dual mode flush valve assembly of claim 2 wherein said upper float comprises a hollow member having a fluid chamber formed therein, at least one fluid port formed in the side wall of said hollow member and a retainer element formed on the upper portion thereof.

4. The dual mode flush valve assembly of claim 3 wherein said upper float further includes a first stop element extending outwardly from the upper end of said hollow member to limit the upward movement thereof relative to said flush valve control assembly.

5. The dual mode flush valve assembly of claim 3 wherein said lower flush actuator comprises a lower actuator flange.

6. The dual mode flush valve assembly of claim 5 wherein said upper float further includes a centrally disposed channel including an offset recess formed in the lower portion thereof.

7. The dual mode flush valve assembly of claim 6 wherein said lower flush actuator assembly includes an upper vertical member extending upwardly from said lower actuator flange telescopingly disposed within said offset recess.

8. The dual mode flush valve assembly of claim 5 wherein outer periphery of said lower actuator flange is curved upwardly to selectively engage the buoyant flush valve when said flush valve actuator is in said lower partial flush position.

9. The dual mode flush valve assembly of claim 1 wherein said flush valve control assembly comprises a stationary attachment member having a movable flush valve control member pivotally attached thereto.

10. The dual mode flush valve assembly of claim 9 wherein said stationary attachment member comprises an attachment element coupled to the toilet flush tank assembly having a said attachment element including a stop element extending down therefrom to engage said flush valve actuator assembly when said flush valve actuator assembly is in said upper buoyant postion to limit the upper movement thereof.

11. The dual mode flush valve assembly of claim 10 wherein stationary attachment member further includes at least one resilient retainer element interconnected to said attachment element by a substantially vertical interconnect element.

12. The dual mode flush valve assembly of claim 10 wherein said movable flush valve control member comprises a normally vertical retainer member pivotally coupled to said attachment element and a normally horizontal flush valve control element.

13. The dual mode flush valve assembly of claim 12 wherein said normally vertical retainer element includes a normally vertical retainer surface and an inclined cam surface.

14. The dual mode flush valve assembly of claim 13 wherein said retainer element is disposed in spaced relationship relative to said normally horizontal retainer surface when said flush valve actuator assembly is in said upper buoyant position and said flush valve control assembly is in said first position and said retainer element is disposed to engage said normally horizontal retainer surface when said flush valve actuator assembly is in said intermediate full flush position and said flush valve control assembly is in said first position.

15. The dual mode flush valve assembly of claim 12 wherein said movable flush valve control member further includes a plurality of detachable tabs each including a normally horizontal retainer surface formed on said normally vertical retainer element.

16. The dual mode flush valve assembly of claim 2 wherein said flush valve actuator assembly further includes a flush regulator means to selectively control the volume of water discharged from the toilet flush tank assembly when operating in said partial flush mode.

* * * * *